US005836797A

United States Patent [19]

Suzuki et al.

[11] Patent Number: 5,836,797

[45] Date of Patent: Nov. 17, 1998

[54] METHOD OF MANUFACTURING A FIELD EMISSION ARRAY

[75] Inventors: Toshihisa Suzuki; Koji Ogata, both of Hamamatsu, Japan

[73] Assignee: Yamaha Corporation, Japan

[21] Appl. No.: 687,759

[22] Filed: Jul. 26, 1996

[30] Foreign Application Priority Data

Jul. 27, 1995 [JP] Japan ..... 7-210986

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS 5,141,459 8/1992 Zimmerman .
5,203,731 4/1993 Zimmerman .
5,334,908 8/1994 Zimmerman .
5,720,642 2/1998 Hattori ..... 445/24 X

FOREIGN PATENT DOCUMENTS 4310604 1/1994 Germany .
6-36682 2/1994 Japan .
6-310043 11/1994 Japan .
92 02030 2/1992 WIPO .

OTHER PUBLICATIONS

S. Zimmerman, et al., "A Fabrication Method for the Integration of Vacuum Microelectronic Devices", IEEE Transactions on Electron Devices, 38 (1991) Oct. No. 10, pp. 2294–2303.

*Primary Examiner*—Kenneth J. Ramsey
*Attorney, Agent, or Firm*—Ostrolenk, Faber, Gerb & Soffen, LLP

[57] ABSTRACT

A gate electrode material film is deposited on a substrate and formed with an opening for each pixel area, and thereafter a first insulating film and an emitter electrode material film are deposited. Slits for separation of emitter lines are formed by etching the emitter electrode material film at the area intersecting with gate lines to be later formed. Thereafter, a second insulating film is deposited and an element substrate is adhered to the second insulating film to remove the initial substrate. The gate electrode material film is thereafter patterned to form a plurality of gate lines and the emitter electrode material film is patterned to form a plurality of emitter lines.

10 Claims, 14 Drawing Sheets

METHOD OF MANUFACTURING A FIELD EMISSION ARRAY

FIELD OF THE INVENTION a) Field of the Invention

The present invention relates to a method of manufacturing a field emission type element using semiconductor manufacture technology in which fine field emission emitters are disposed in a matrix form.

b) Description of the Related Art

Research and development of fine field emission emitters (cold cathode) have been made recently by utilizing fine processing techniques of semiconductor integrated circuits. Application of field emission emitters is expected to the fields of vacuum micro elements, flat panel displays, and the like. One of typical fine emitter manufacture methods is a so-called mold method by which recesses having fine and sharp valleys are formed in a substrate, and an emitter electrode material film is deposited over the recesses to form fine emitters embedded in the recesses.

For example, the following processes are used for generating a field emission type element with a gate electrode by the mold method. First, a gate electrode material film is formed on a starting substrate, and the gate electrode material film is patterned to form an opening at the region where a field emission emitter is formed. Next, an insulating film is deposited on the gate electrode material film so that a sharp recess conformal to the underlying opening is formed on the surface of the insulating film. An emitter electrode material film is deposited on the insulating film with the recess to embed a field emission emitter in the recess. Thereafter, an element substrate is adhered to the emitter electrode material film and then the starting substrate is removed.

A fundamental method of manufacturing a field emission type element by the mold method is described, for example, in U.S. Pat. No. 5,203,731. Another method has been proposed by which a gate electrode is not formed on a starting substrate, but a gate electrode material film is formed, after a field emission emitter is formed on the starting substrate and an element substrate is adhered to the field emission emitter to remove the starting substrate (e.g., JP-A 6-36682).

By the above-described processes, a device (field emission emitter array) having a plurality of field emission emitters disposed in a matrix form can be manufactured. In this case, the gate electrode material film and emitter electrode material film are patterned so that a plurality of gate lines and emitter lines are intersected. An opposing substrate formed, for example, with a fluorescent film is assembled with a field emission emitter array having field emission emitters disposed in a matrix form, and this assembly is vacuum sealed to obtain a flat panel display capable of being driven line sequentially (refer to JP-A 6-36682).

FIG. 13 is a broken and partial perspective view of a flat panel display having the structure disclosed in JP-A 6-36682. A plurality of intersected emitter and gate lines 1202 and 1203 are formed on an element substrate 1201. Each intersection area of the emitter and gate lines 1202 and 1203 corresponds to one pixel area. An opening 1206 is formed at this intersecting area in an insulating film on the gate line 1203. Field emission emitters 1207 formed along the emitter line 1202 is exposed from the openings 1206. In the example shown in FIG. 13, four field emission emitters are used for each pixel.

An opposing glass substrate 1210 formed with a transparent electrode 1208 made of ITO (indium-tin oxide) or the like and a fluorescent film 1209 is assembled with the field emission emitter array, and this assembly is vacuum sealed to obtain a flat panel display. For vacuum sealing, anode bonding or bonding using glass having a low melting point may be used. A vacuum sealing method using anode bonding is described, for example, in JP-A 6-310043. With this method, the junction surfaces of elements are required to be planarized to remove steps on the surfaces. With the method using glass having a low melting point, glass is melted at a temperature of several hundred degrees of Celsius (°C.) so that good vacuum sealing is possible even if some steps exist.

Conventional field emission emitter manufacture methods are, however, associated with the following problems.

First, as seen from FIG. 13, it is necessary to etch the emitter electrode material film under the gate line 1203 to pattern the emitter line 1202. This etching process is required before the element substrate 1201 is adhered. However, if the emitter line 1202 is patterned before the element substrate 1201 is adhered and the element substrate 1201 is thereafter adhered to remove the starting substrate, the gate electrode material film hovers over the element substrate 1201 at a relatively broad area along the emitter lines 1202 and rides on the emitter lines 1202 like bridges. Since the gate electrode material film is as thin as about 0.5 $\mu$m, the gate electrode material film at the bridge area may be damaged easily at later processes.

Second, the vacuum sealing using glass having a low melting point poses the following problem. This problem will be described with reference to FIGS. 14A and 14B which are cross sectional views respectively taken along lines A–A' and B–B' of FIG. 13. Although not shown in FIGS. 13, the element substrate 1201 is adhered to the field emission emitter array by an insulating film 1212 and a conductive adhesive layer 1213. During the vacuum sealing by glass 1211 shown in FIGS. 14A and 14B having a low melting point, the glass 1211 having a low melting point heated to about 400° C. inevitably permeates through the insulating films 1205 and 1204 made of $SiO_2$ or the like. In FIGS. 14A and 14B, crossed hatched regions 1214 are the glass permeated regions.

As particularly shown in the cross section of FIG. 14A, if the low melting point glass 1211 permeates through the insulating film 1204 between the gate line 1203 and emitter line 1202, this low melting point glass permeated region 1214 lowers the dielectric breakdown voltage and if the region between the gate line 1203 and emitter line 1204 becomes electrically conductive, the element function is destructed. In order to avoid the gate-emitter contact, the insulating film 1204 should be made thick. However, the permeating depth of low melting point glass is about 0.5 $\mu$m, whereas the thickness of the insulating film 1204 cannot be made thicker than about 0.2 to 0.3 $\mu$m because this film is used as a mold die for the field emission emitter.

Another method of avoiding the gate-emitter contact is to etch and remove the emitter electrode material film under the lead-out portion of the gate line 1203, i.e., under the portion where the low melting point glass 1211 is coated. However, since etching the emitter electrode material film is performed before the element substrate is adhered, a broad recess is formed at the region where the emitter electrode material film is etched and removed so that defect adhesion to the element substrate may occur. This defective adhesion is illustrated in FIG. 15 corresponding to the cross section of FIG. 14B. A gap 1215 shown in FIG. 15 is formed where the emitter electrode material film is removed, and this gap may cause the defective adhesion to the element substrate.

SUMMARY OF THE INVENTION

An object of the present invention is to provide a method of manufacturing a field emission emitter capable of avoiding a destruction of the element during manufacture processes, an electrical contact between the gate and emitter lines during the vacuum sealing using low melting point glass, and a defective adhesion to the element substrate.

According to one aspect of the present invention, there is provided a method of manufacturing a field emission array, comprising the steps of: a) providing a substrate having a gate layer and an insulating layer; b) forming a hole through the gate layer; c) forming a sacrificial layer over the gate layer, the sacrificial layer having a cusp thereon; d) forming an electron emission layer on the sacrificial layer to provide a tip which is conformal to the cusp; e) defining a vacuum region on the electron emission layer to be served under a vacuum ambient realized by being sealed into with sealing material; f) forming a plurality of slits in the electron emission layer within the vacuum region; g) patterning the gate layer to provide a gate element for the tip and a contact electrode; and h) patterning the electron emission layer to provide an electron emitter layer and a dummy layer under the contact electrode, the dummy layer being electrically isolated from the electron emitter layer by the slit.

The patterning processes of emitter lines are divided into two processes. The first patterning process forms only the slits necessary for separation of the emitter lines under the gate lines to be later patterned. The element substrate is adhered, the initial substrate is removed, and the gate lines are patterned, and thereafter the second patterning of the emitter lines is performed. Therefore, until the gate lines are patterned, the emitter electrode material film is almost left unetched and the area of the bridge structure of the gate electrode material film when the initial substrate is removed, is so small that the element breakage during processes can be reliably avoided.

If the vacuum sealing using low melting point glass is performed, the emitter electrode material film under the gate lines where the low melting point glass is disposed, is made a dummy pattern electrically separated from the emitter lines. Therefore, even if low melting point glass permeates through the insulating film, electrical contact is avoided between the emitter lines and gate lines to allow to obtain a field emission emitter array having a desired function.

Still further, since the element substrate is adhered in the state that most of the emitter electrode material film is left unetched, steps are small and the element substrate can be adhered with a sufficiently strong adhesive force.

DETAILED DESCRIPTION OF THE PREFERRED EMBODIMENTS

An embodiment of the present invention will be explained with reference to a manufacturing process depicted in FIGS. 1A–1D to FIGS. 9A and 9B.

Figure 1A:
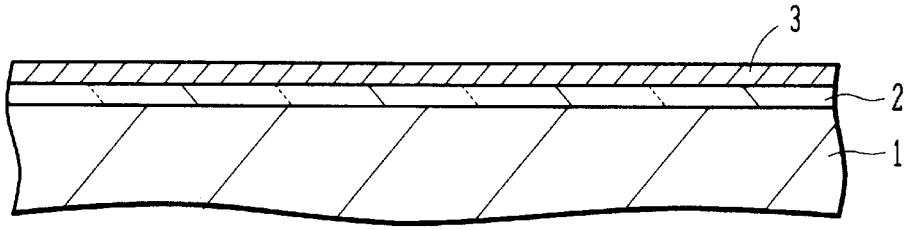
FIGS. 1A to 1D illustrate the processes up to an emitter film deposition process of a method of manufacturing a field emission emitter array according to an embodiment of the invention.

FIGS. 1A to 1D illustrate a process of depositing an emitter electrode material film on a substrate 1 made of, for example, monocrystalline silicon. The substrate 1 may be made of glass, Ge, GaAs, Al, Cu, and the like as well as monocrystalline silicon. In FIG. 1A, an $SiO_2$ film is formed to a thickness of about 500 nm on the substrate 1 by thermal oxidation. Next, a gate electrode material film 3 made of, for example, silicon is formed on the $SiO_2$ film 2 through low pressure CVD using $SiH_4$ and $N_2$. Cu, Al, Cr, Au, Mo, W, Ta, Ni, Nb may also be used as the gate electrode material film 3. Thereafter, impurities are doped to lower the resistance of the gate electrode material film 3. The thickness of the gate electrode material film 3 is about 150 nm.

Figure 1B:
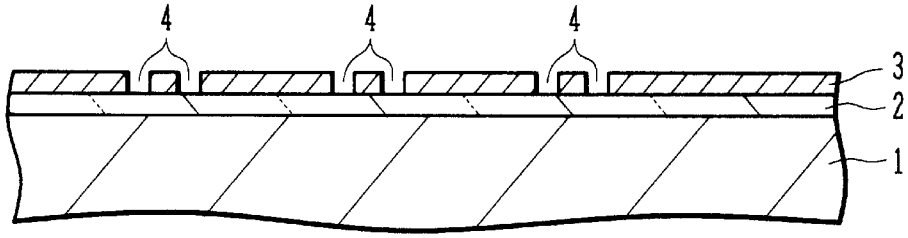

Next, as shown in FIG. 1B, the gate electrode material film 3 is selectively etched to form therein openings 4 at respective pixel areas disposed in a matrix form. The diameter of each opening 4 is about 450 nm.

Figure 1C:
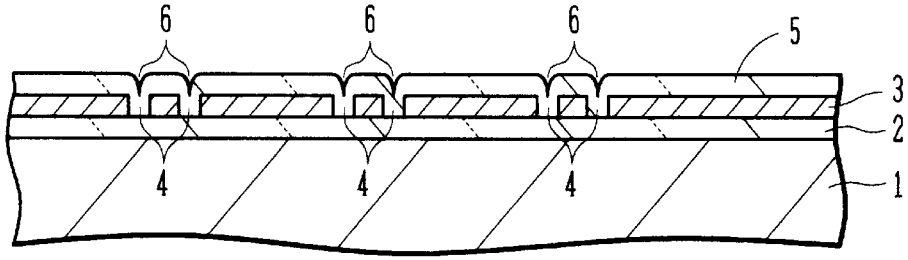

Next, as shown in FIG. 1C, a first insulating film 5 made of silicon oxide film is deposited by atmospheric pressure CVD using ozone and TEOS (tetraethoxyorthosilicate). The thickness of the first insulating film 5 is about 250 nm. On the surface of the first insulating film 5, sharp recesses (cusp) 6 are formed which are used as emitter forming mold dies.

Figure 1D:
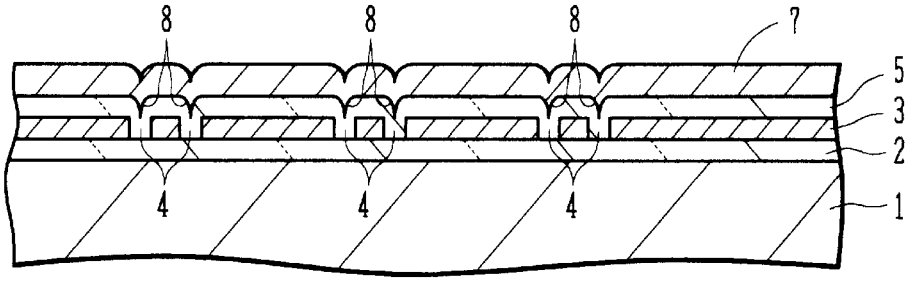

Next, as shown in FIG. 1D, an emitter electrode material film 7 is deposited on the whole surface, the emitter electrode material film 7 has the upper surface conformal to the surface of the underlying first insulating film 5. The emitter electrode material film 7 is a laminate of TiN of about 200 nm thick and Si of about 100 nm. Cr may be used in place of Si. Mo, W, Ta, Ni, Au, Nb, TiN, NbC, $LaB_6$ may also be used as the emitter electrode material film 7. In this state, a cusp-like fine field emission emitter tip 8 is formed embedded in a recess 6 corresponding to each opening 4.

Figure 2A:
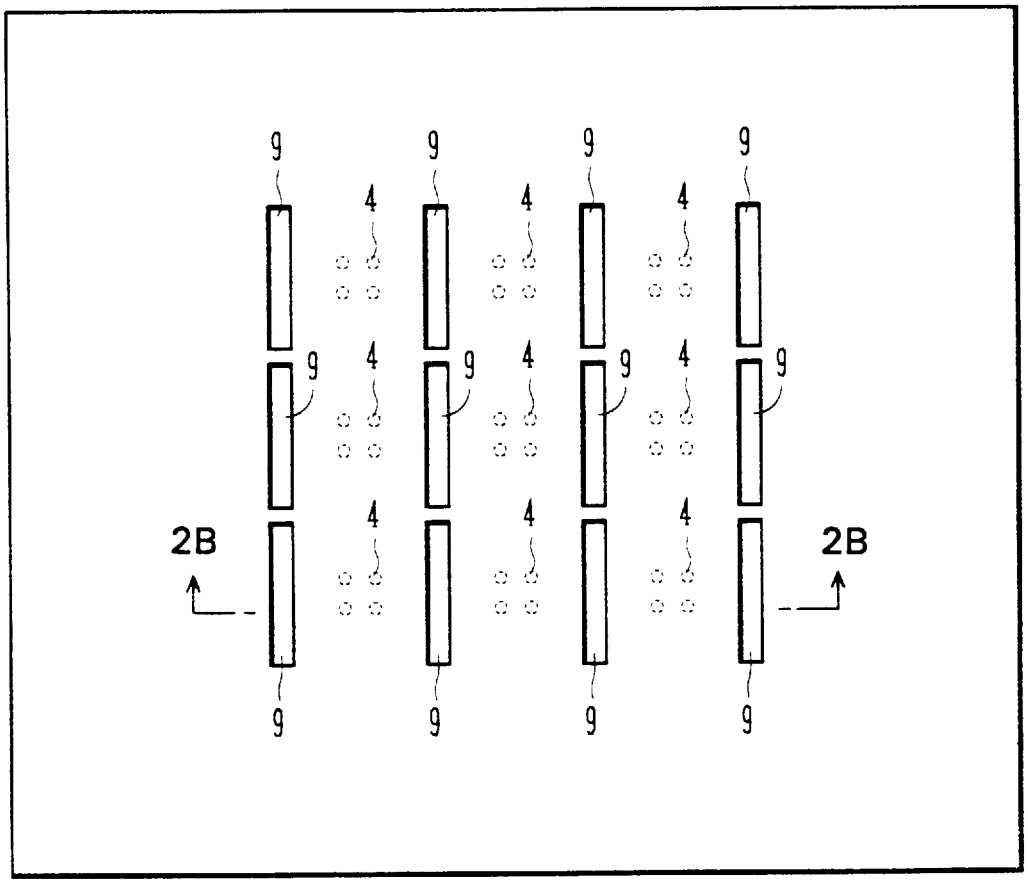
FIGS. 2A and 2B illustrate a first process of patterning an emitter electrode material film of the manufacturing method.
Figure 2B:
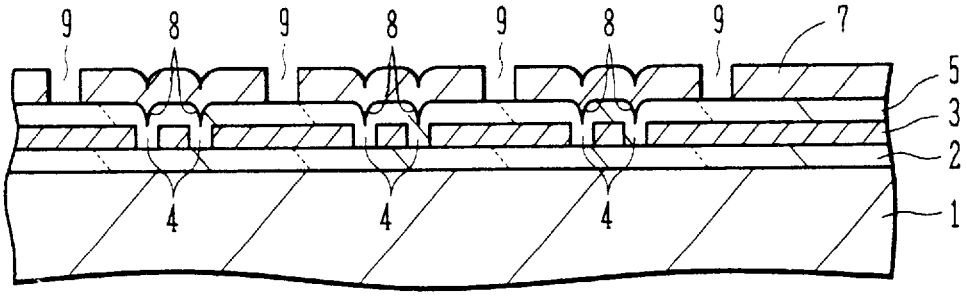

Thereafter, a first patterning of the emitter electrode material film 7 is performed. FIG. 2A is a plan view of the substrate, and FIG. 2B is a cross sectional view taken along line A–A'. As shown in FIGS. 2A and 2B, slits 9 for emitter line isolation are formed in the emitter electrode material film 7 only at the area where the gate electrode material film 3 is left later as the gate line. The width of this slit 9 is 10 μm or narrower. The area inside of the outermost groups of slits 9 (the slit groups at the rightmost and leftmost columns shown in FIG. 2A) is positioned inside of the area where low melting point glass for sealing the element is formed.

In FIG. 2A, although an emitter array having 3×3 pixels each having four field emission emitters 8 is shown for the purpose of description simplicity, a number of pixels are disposed in a matrix form in practice.

Figure 3A:
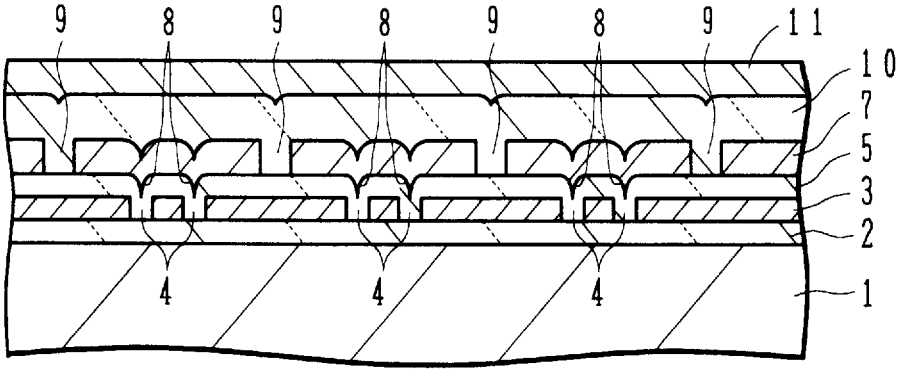
FIGS. 3A and 3B illustrate an element substrate adhesion process of the manufacturing method.

Next, as shown in FIG. 3A, a second insulating film 10 is deposited on the emitter electrode material film 7 formed with narrow slits. As the second insulating film 10, an $Al_2O_3$ film of about 2 μm thick is formed by sputtering. $SiO_2$ or $Ta_2O_5$ may also be used as the second insulating film 10. If the deposition thickness of the second insulating film 10 is thin, the surface of the second insulating film 10 becomes irregular reflecting the slits 9 formed in the emitter electrode material film 7. It is desired that the surface of the second insulating film 10 is as flat as possible for the next element substrate adhesion process. If the width of the slit 9 is as wide as 100 μm, the deposited second insulating film 10 is not flat. In such a case, the second insulating film 10 is deposited, for example, to 20 μm and thereafter polished to planarize it.

As also shown in FIG. 3A, a conductive adhesive layer 11 is formed on the second insulating film 10 for the anode bonding of the element substrate. As the conductive adhesive layer 11, an Al film or Si film of about 0.3 μm thick formed by sputtering is used. A Ta film may also be used as the conductive adhesive layer 11. If an Al sputter film is used as the adhesive layer 11, the anode bonding can be easily performed at about 450° C. If a Si sputter film is used, although it shows a high resistance like an insulator at the room temperature, it shows a low resistance at an anode bonding temperature of about 450° C. allowing to perform the anode bonding. The high resistance like an insulator at the room temperature is very effective for achieving a desired function of a field emission type element.

Figure 3B:
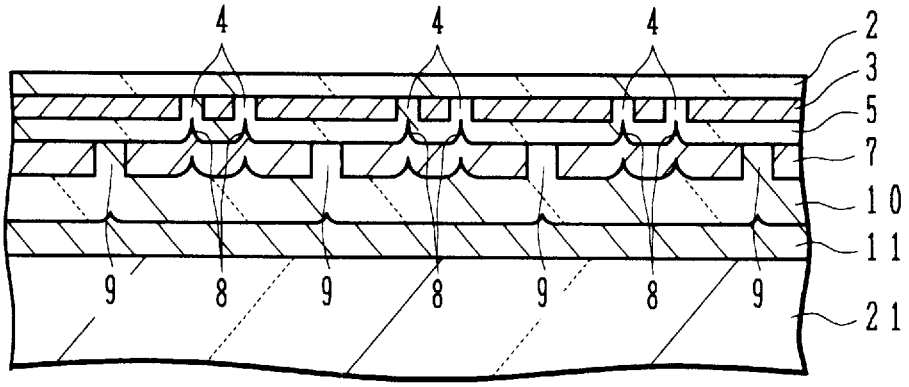

Thereafter, as shown in FIG. 3B which is turned upside down as different from FIG. 3A, a glass substrate 21 is anode coupled upon application of a voltage of about 1 kV to thereafter remove the substrate 1. In this embodiment, the substrate 1 is made of, for example, silicon, and removed by etching solution (EDP etchant) of ethylenediamine, catechol, and water. If the thickness of the substrate 1 is 0.6 mm, the etching time is about 10 hours. In order to shorten the etching time, another etching process may be combined by using etchant of hydrofluoric acid, nitric acid, and acetic acid. The $SiO_2$ film 2 on the substrate 1 is a stopper of the EDP etching.

Figure 4A:
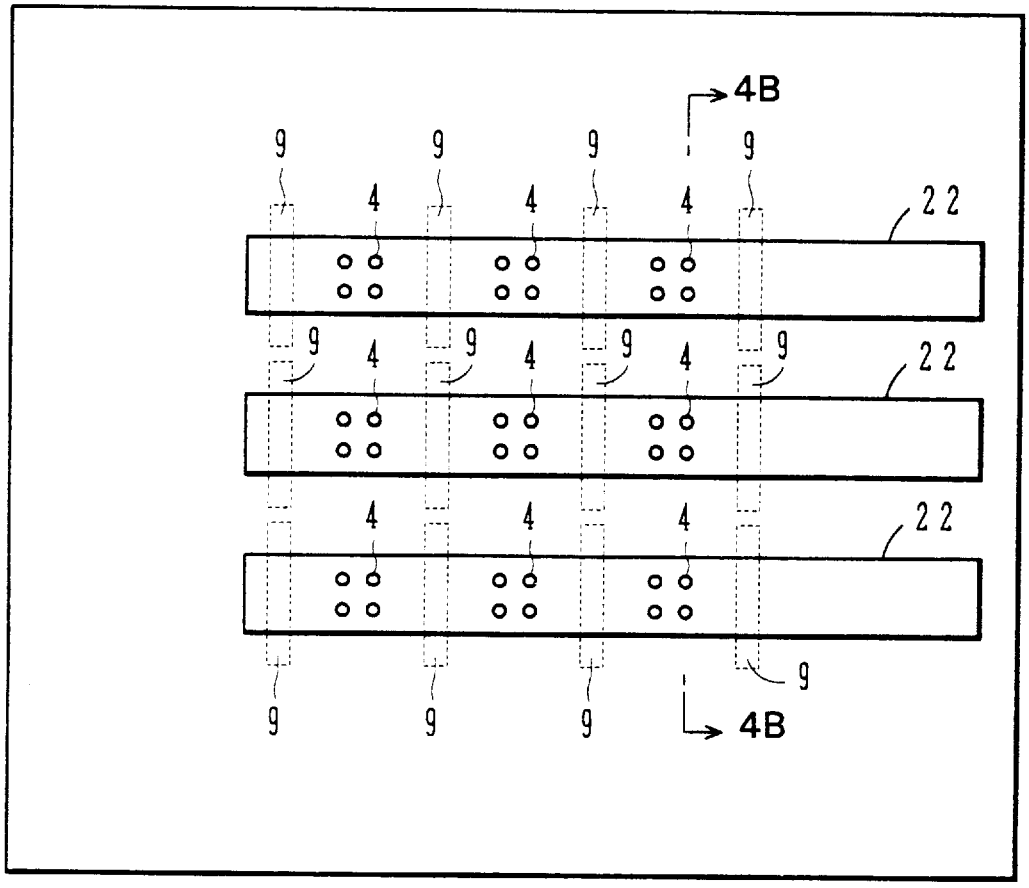
FIGS. 4A and 4B illustrate a gate line patterning process of the manufacturing method.
Figure 4B:
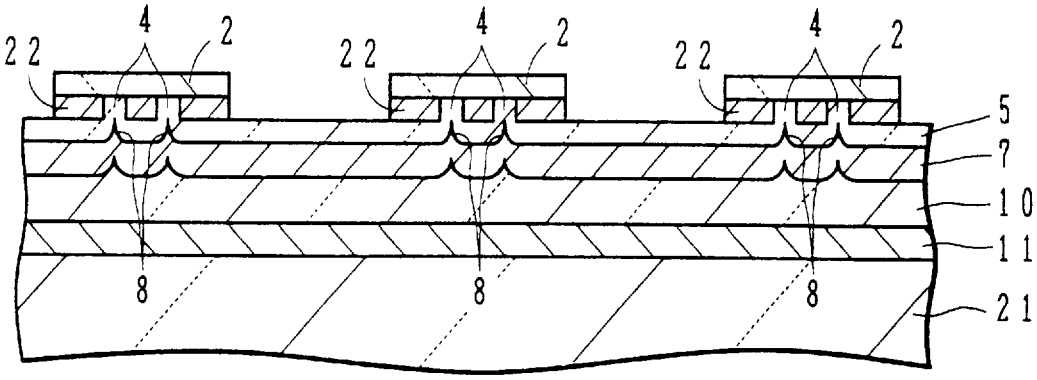

Next, as shown in FIG. 4A, the gate electrode material film 3 is patterned to form a plurality of gate lines 22 separated and running in one direction of the pixel matrix. FIG. 4A is a plan view of the substrate, and FIG. 4B is a cross sectional view taken along line A–A'. In this embodiment, first the $SiO_2$ film 2 on the gate electrode material film 3 is selectively etched by using a resist pattern, and next, by using the patterned $SiO_2$ film 2 as an etching mask, the gate electrode material film 3 is selectively etched. The $SiO_2$ film 2 is patterned through wet etching using buffered hydrofluoric acid.

Figure 5:
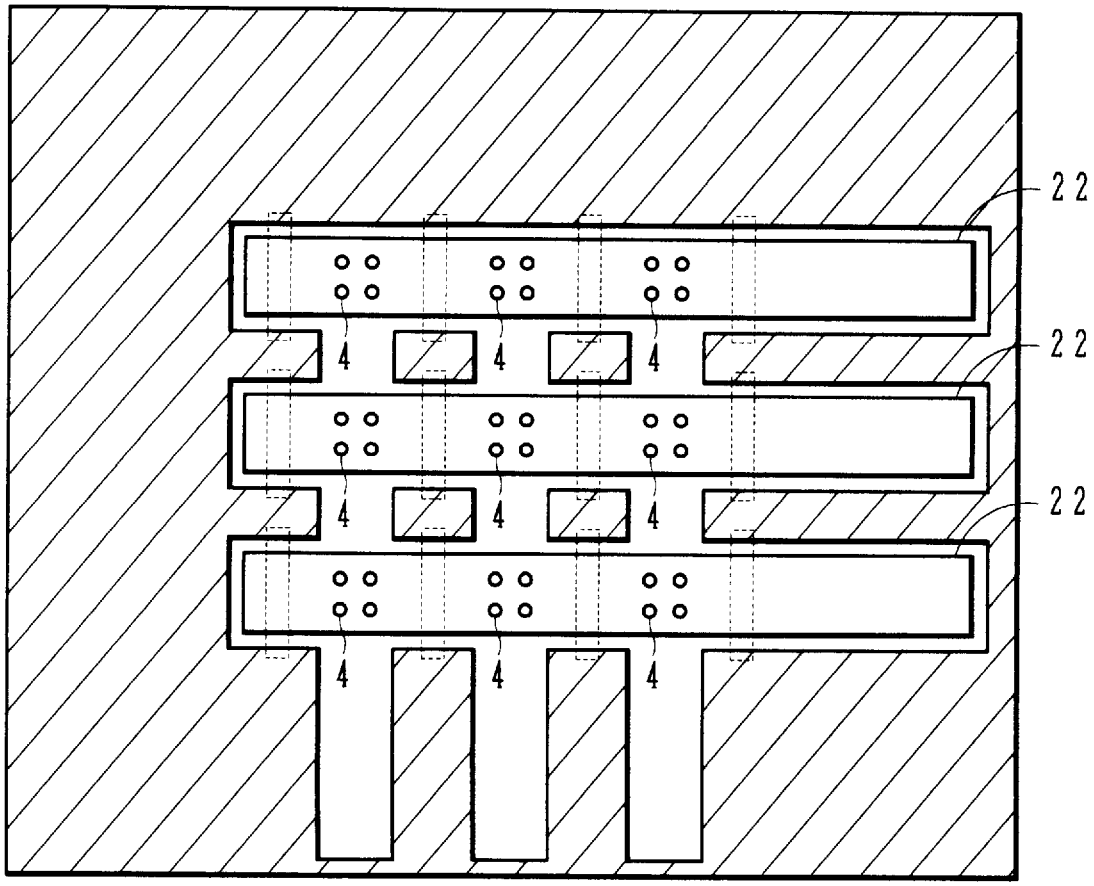
FIG. 5 illustrates a second process of patterning the emitter electrode material film of the manufacturing method.
Figure 6A:
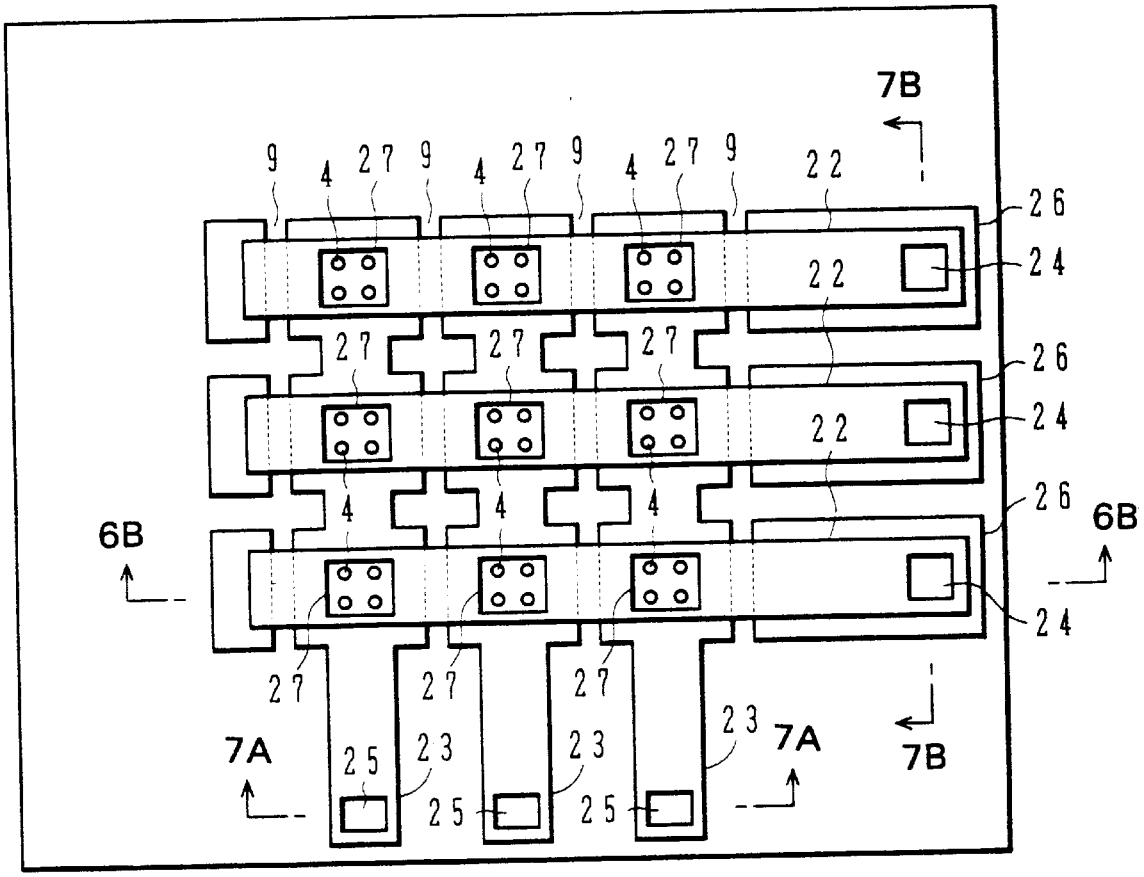
FIGS. 6A and 6B illustrate how emitter lines are separated by the second patterning process.
Figure 6B:
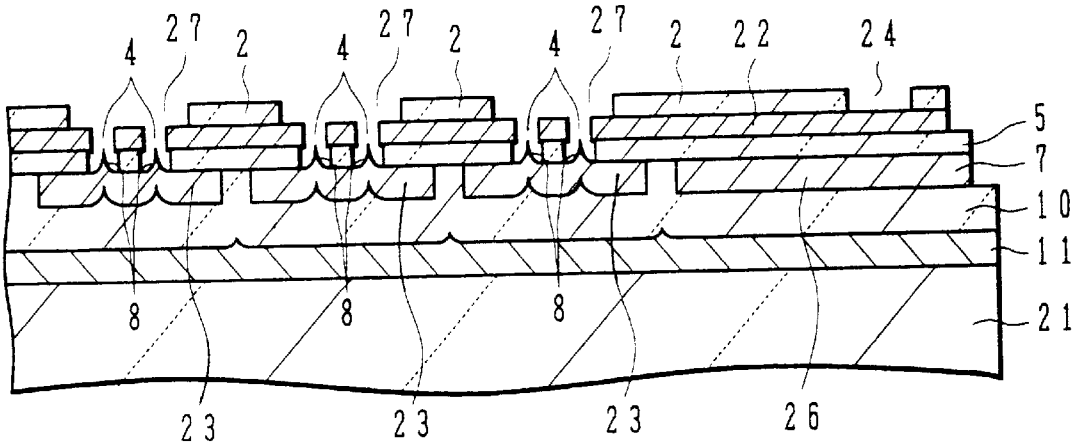

Next, the second patterning of the emitter electrode material film 7 is performed. In the second patterning, the gate line 22 and the region between the gate lines 22 necessary for the emitter lines are covered with a resist mask to selectively etch the first insulating film 5, and then the emitter electrode material film 7 is selectively etched by using the first insulating film 5 as the etching mask. The hatched area in FIG. 5 is the etched area in this second patterning. In this manner, as shown in the plan view of FIG. 6A and the cross sectional view of FIG. 6B taken along line A–A', a plurality of emitter lines 23 separated by the slits 9 from, and intersecting with, the gate lines 22 are formed. With this etched and patterned emitter electrode material film 7, the regions of the emitter electrode material film 7 where contact holes 24 are later formed for connecting to an external circuit are physically and electrically separated from the regions where the emitters 8 are formed.

In order to connect the gate lines 22 and emitter lines 23 to external circuits, the $SiO_2$ film 2 and insulating film 5 formed over these lines are selectively etched to form contact holes 24 and 25. The $SiO_2$ film is removed through wet etching using buffered hydrofluoric acid.

Figure 7A:
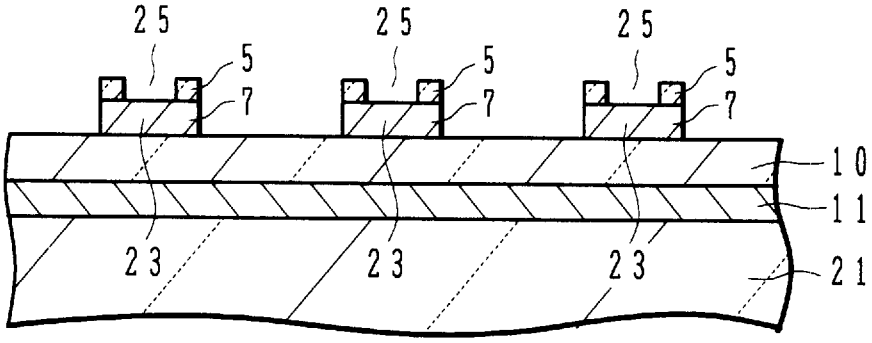
FIGS. 7A and 7B are cross sectional views taken along lines B–B' and C–C' shown in FIG. 6A.
Figure 7B:
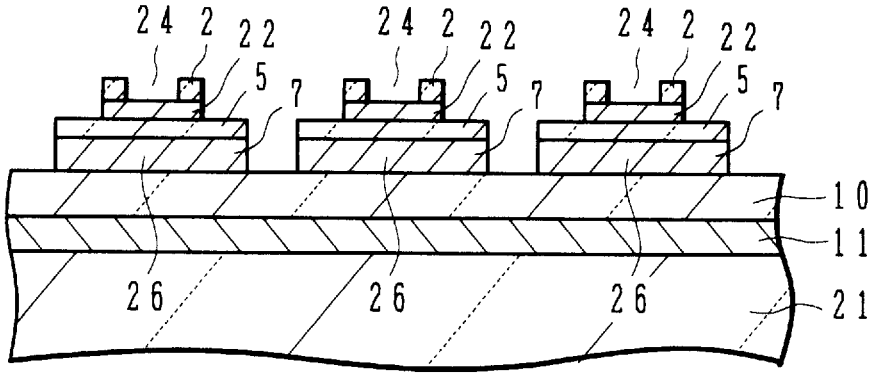

At the same process or a later process, the $SiO_2$ film 2 on the gate lines 22 and the first insulating film 5 exposing in the openings 4 are etched to open windows 27 exposing the tips of the field emission emitters 8 at each pixel area. FIGS. 7A and 7B are cross sectional views respectively taken along lines B–B' and C–C' of FIG. 6A.

A dummy pattern 26 separated from the emitter lines 23 is left under the lead-out region of the gate lines 22 to the external circuit, after the two patterning processes of the emitter electrode material film 7.

Figure 8A:
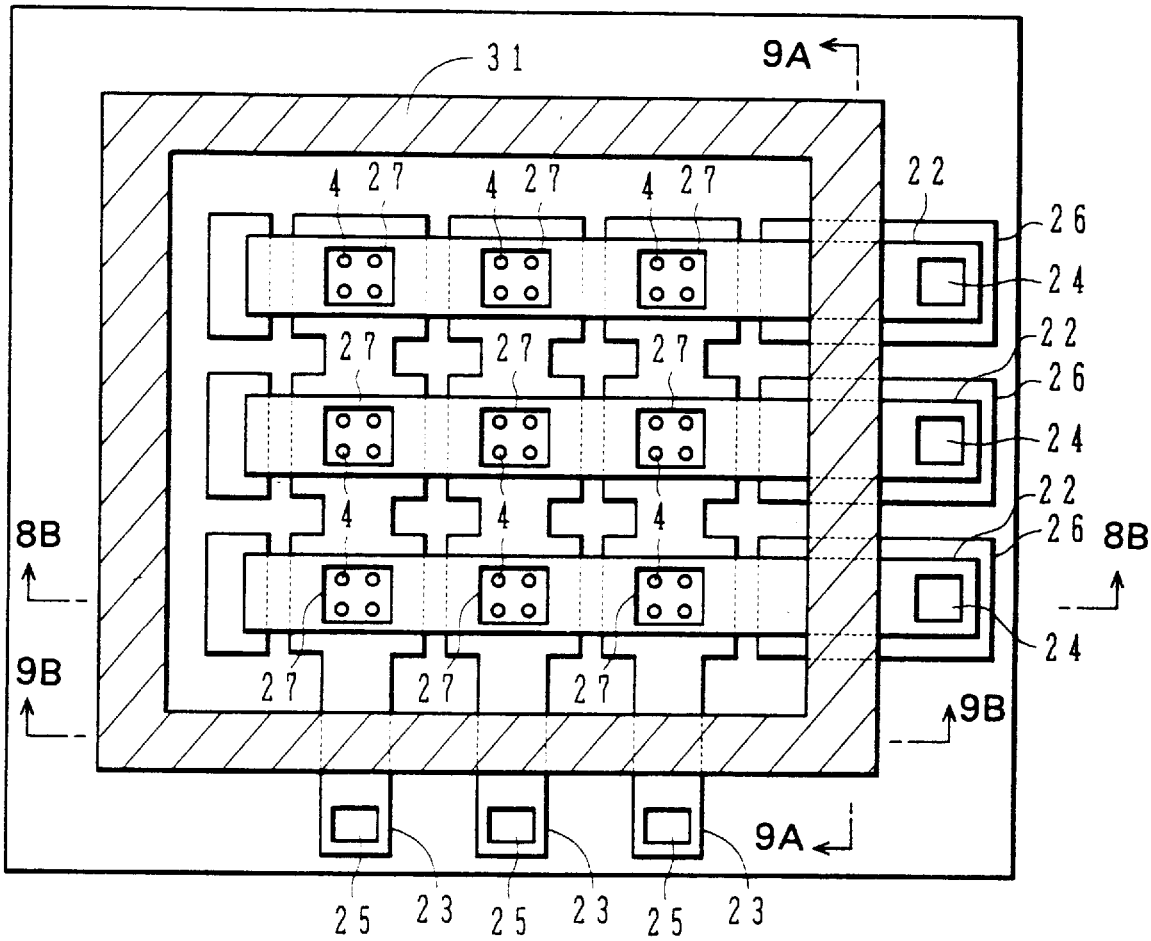
FIGS. 8A and 8B illustrate a vacuum sealing process of the manufacturing method.
Figure 8B:
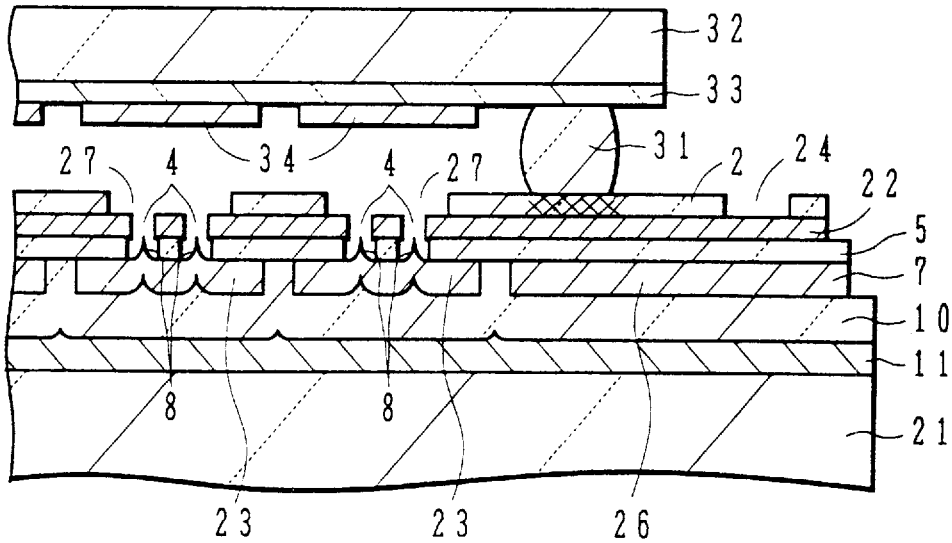
Figure 9A:
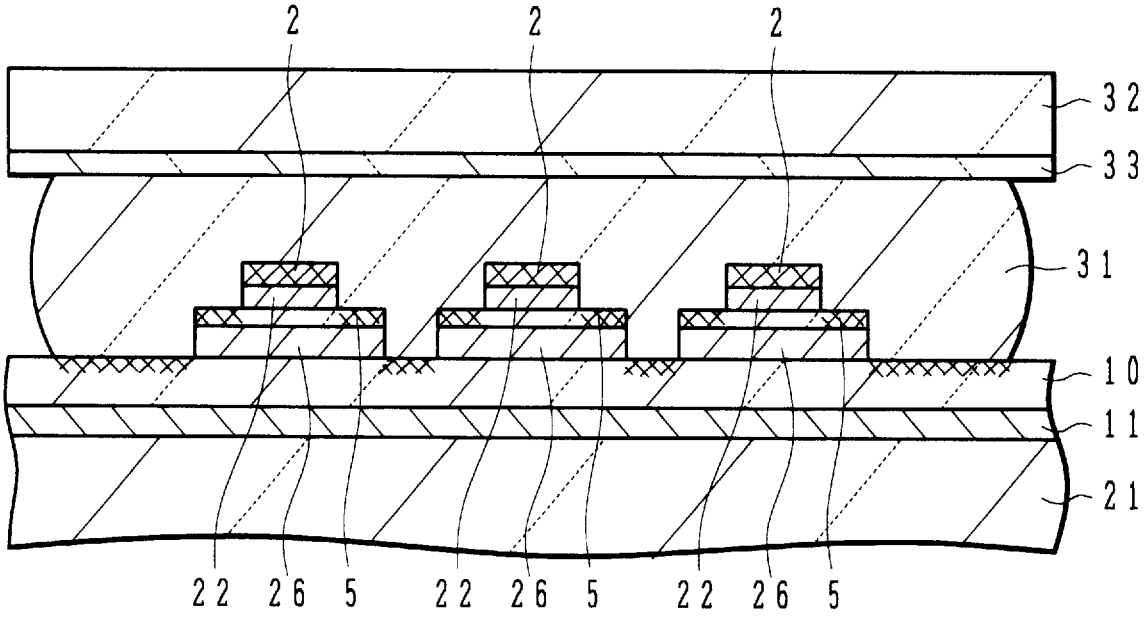
FIGS. 9A and 9B are cross sectional views taken along lines B–B' and C–C' shown in FIG. 8A.
Figure 9B:
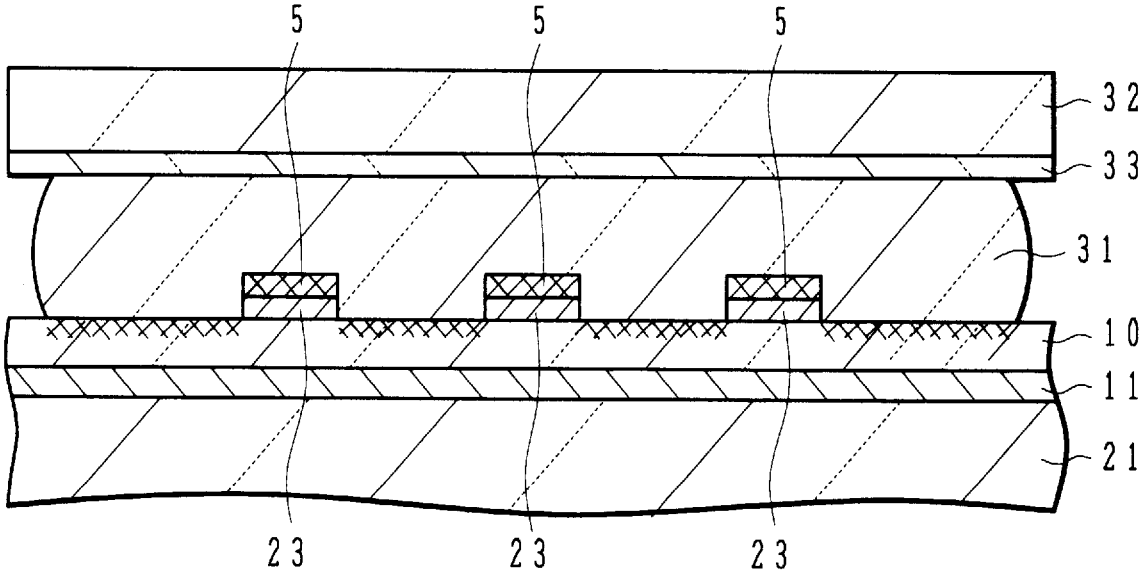

In this embodiment, the field emission emitter array formed in the above manner is vacuum sealed using low melting point glass to form a flat panel display. This display structure is shown in FIGS. 8A and 8B, and 9A and 9B. FIG. 8A is a flat transparent view by omitting a fluorescent film, FIG. 8B is a cross sectional view along the gate line 22 taken along line A–A? of FIG. 8A, and FIGS. 9A and 9B are cross sectional views of the lead-out portion of the gate lines 22 and the lead-out portion of the emitter lines 23 with the low melting point glass 31, respectively taken along lines B–B' and C–C'.

A substrate 32 disposed opposing the field emission emitter array is, for example, a glass substrate, and on its surface a transparent anode electrode 33 made of ITO or the like is formed. A fluorescent film 34 is formed at areas corresponding to respective pixel areas. As shown by hatched lines in FIG. 8A. the low melting point glass 31 is coated on the peripheral area of the field emission emitter array (inside of the contact holes 24 and 25 of the gate lines 22 and emitter lines 23), and the field emission emitter array is disposed facing the opposing substrate 32 at a predetermined gap therebetween and vacuum sealed.

During the vacuum sealing by the low melting point glass 31, the glass permeates through the insulating film as described with the related art. In FIG. 8B and FIGS. 9A and 9B, crossed hatched lines indicate the state of permeation of the low melting point glass through the insulating films 2, 5 and 10. Permeation of low melting point glass into the insulating film 5 between the gate electrode material film 22 and emitter electrode material film 26 shown in the cross sectional view of FIG. 9A may cause electrical contact therebetween. In this embodiment, however, the emitter electrode material film under the lead-out portion of the gate lines 22 is the dummy pattern 26 fully separated from the emitter lies 23. Therefore, even if electrical contact is made between the gate electrode material film 22 and dummy pattern 26 by the permeated low melting point glass, the emitter lines 23 are electrically isolated from the dummy pattern 26 under the gate lines 22 by the slits 9, so that the emitter lines 23 are not electrically connected to the gate lines 22.

If the thickness of the insulating film 10 is 0.5 $\mu$m or thicker, permeation of low melting point glass through the insulating film 10 will not cause electrical contact between the emitter lines 23 and conductive adhesive layer 11 (contacts between emitter lines). Even if the low melting point glass permeates through the insulating film 10 to the underlying conductive adhesive layer 11, if this layer is made of Si, it has a high resistance at the room temperature and insulation between emitter lines is ensured.

In this embodiment, the emitter electrode material film is patterned two times. The first patterning forms only the slits necessary for separation of the emitter lines under the gate lines to be later patterned. The element substrate is adhered, the initial substrate is removed, and the gate lines are patterned, and thereafter the second patterning is performed. Therefore, until the gate lines are patterned, the emitter electrode material film is almost left unetched and the area of the bridge structure of the gate electrode material film when the initial substrate is removed, is so small that the element breakage during processes can be reliably avoided.

In this embodiment, the second insulating film 10 is planarized for the adhesion of the element substrate. Instead of planarizing the second insulating film 10, the conductive adhesive layer 11 on the second insulating film 10 may be planarized. In this case, the conductive adhesive layer 11 is deposited sufficiently thick and polished to planarize it.

Also in this embodiment, the portion of the emitter electrode material film 7 under the lead-out portion of the gate lines 22 is left as the dummy pattern 26. If this dummy pattern 26 is completely removed, gate-emitter contact can be avoided more reliably.

Figure 10:
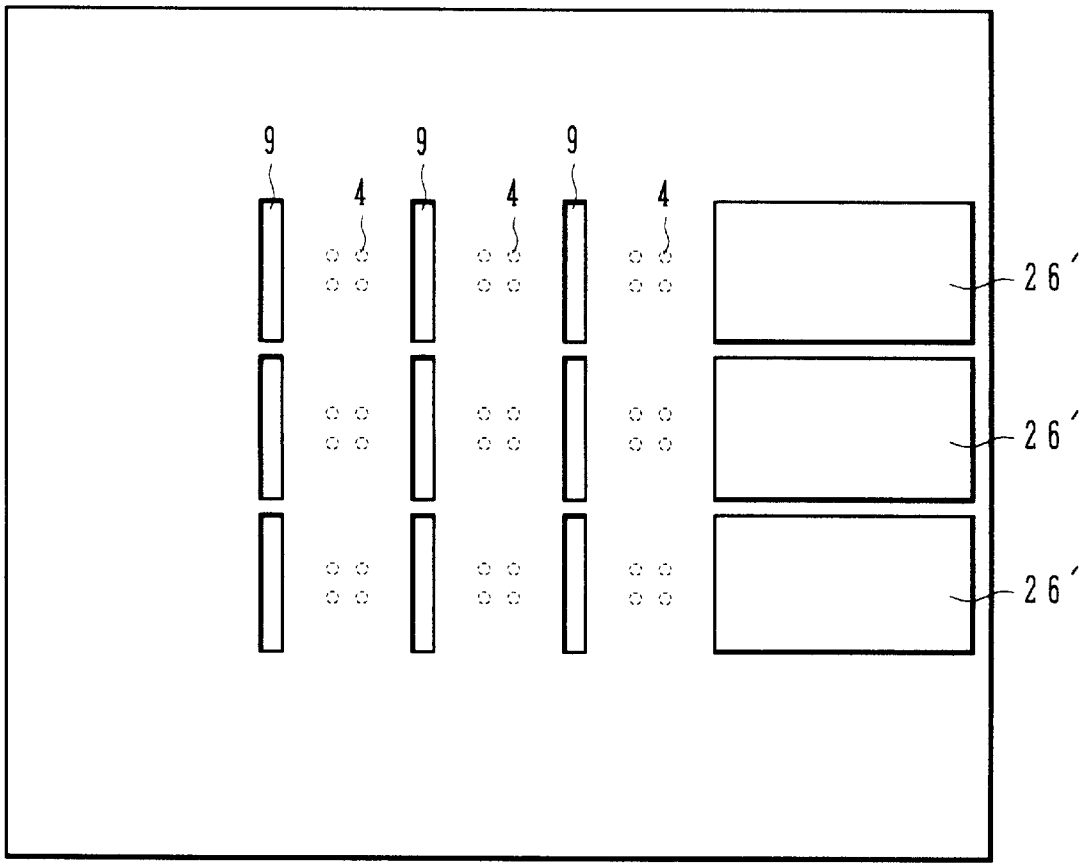
FIG. 10 shows a pattern corresponding to Figs.2A and 2B according to another embodiment.

FIG. 10 is a plan view of a second embodiment illustrating a process of removing the dummy pattern 26, corresponding to FIGS. 2A and 2B. At the process of patterning the slits 9, large openings 26' are formed at the areas corresponding to the dummy pattern 26 as shown in Fig.10. The openings 26' form recesses so that the second insulating film 10 or the higher level conductive adhesive layer 11 are necessary to be planarized by all means for the adhesion of the element substrate.

Figure 11:
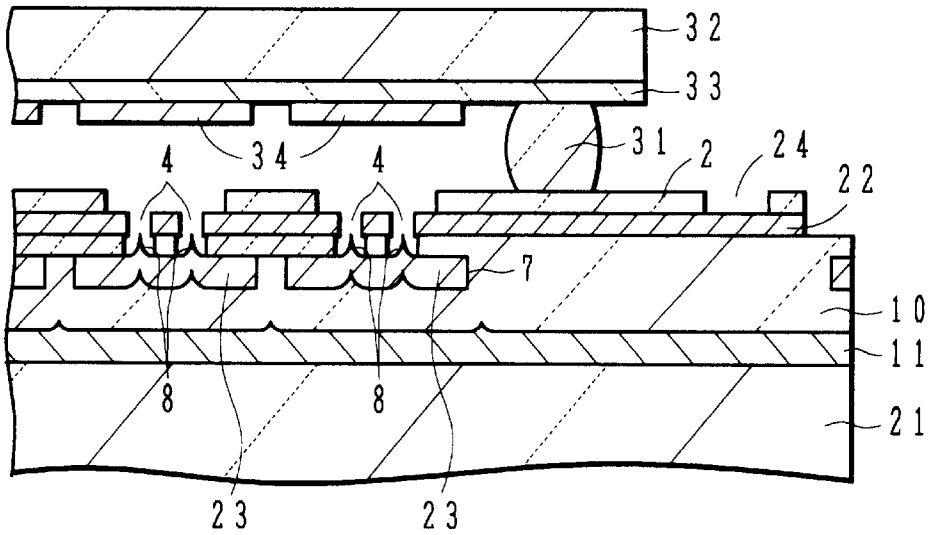
FIG. 11 is a cross sectional view corresponding to FIG. 8B of the embodiment.

FIG. 11 is a cross sectional view without the dummy pattern under the lead-out portion of the gate lines, corresponding to FIG. 8B.

In the above embodiment, after the gate electrode material film 3 is formed on the substrate 1, the emitter electrode material film 7 is formed with the first insulating film 5 interposed therebetween. The processes of manufacturing a field emission emitter array of this invention are not limited thereto. For example, the gate electrode material film 3 may be formed after the adhesion of the element substrate 21 and removal of the substrate 1. The fundamental processes of forming a field emission emitter array different from the above embodiment are shown in FIGS. 12A to 12E. FIGS. 12A to 12E show only one emitter portion, and like elements to those of the above embodiment are represented by identical reference numerals.

Figure 12A:
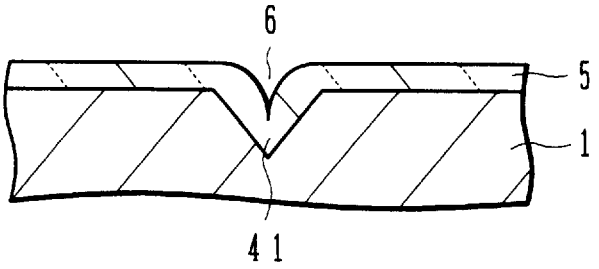
FIGS. 12A to 12E illustrate a method of manufacturing a field emission emitter array according to another embodiment of the invention.
Figure 12B:
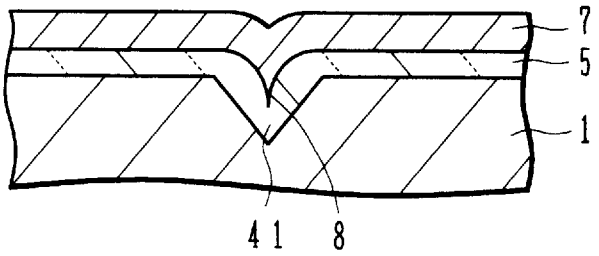

As shown in FIG. 12A, a recess 41 is formed on a substrate 1 at an emitter forming region of each pixel, and a first insulating film 5 is deposited thereon. On the surface of the first insulating film 5, a cusp 6 having a sharp tip conformal to the recess 41 of the substrate 1 is formed, this cusp 6 being a mold die for forming an emitter. Next, as shown in FIG. 12B, an emitter electrode material film 7 is deposited to form a field emission emitter 8 embedded in the recess 6.

Figure 12C:
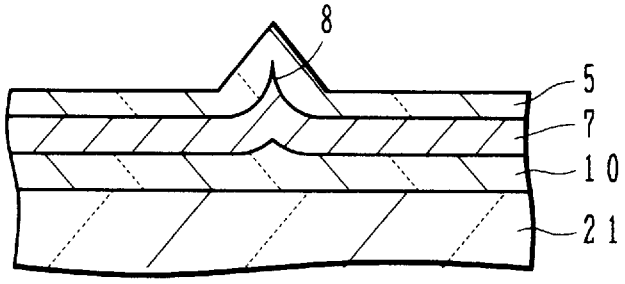

In the state shown in FIG. 12B, slits are formed in the emitter electrode material film 7 for separation of emitter lines at the regions where gate lines are disposed later, in the manner similar to the above embodiment described with FIGS. 2A and 2B. As shown in FIG. 12C which is turned upside down different from FIG. 12B, a second insulating film 10 is deposited, an element substrate 21 is adhered, and thereafter the substrate 1 is removed, in the manner similar to the above embodiment. In FIG. 12C, a conductive adhesive layer is not shown.

Figure 12D:
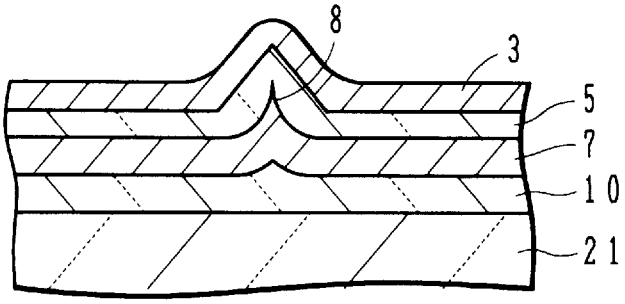
Figure 12E:
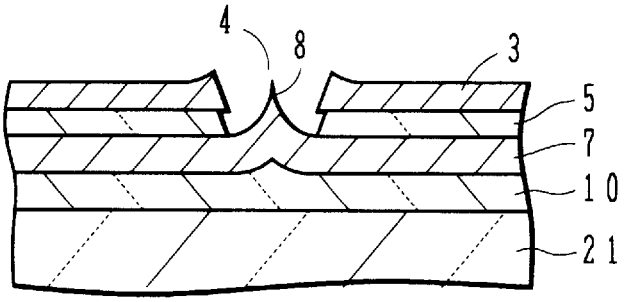
Figure 13:
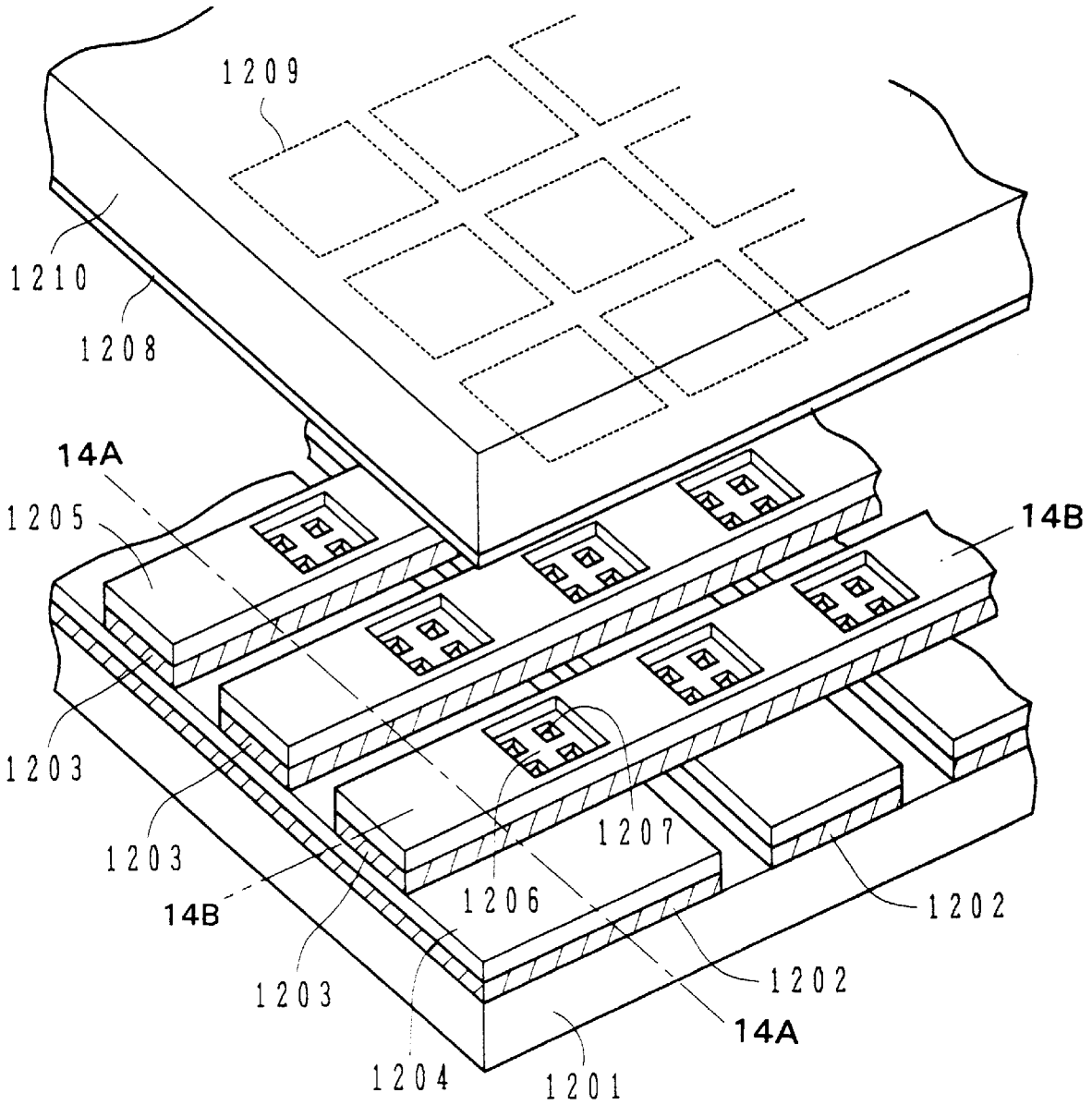
FIG. 13 shows a conventional field emission emitter array vacuum sealed.
Figure 14A:
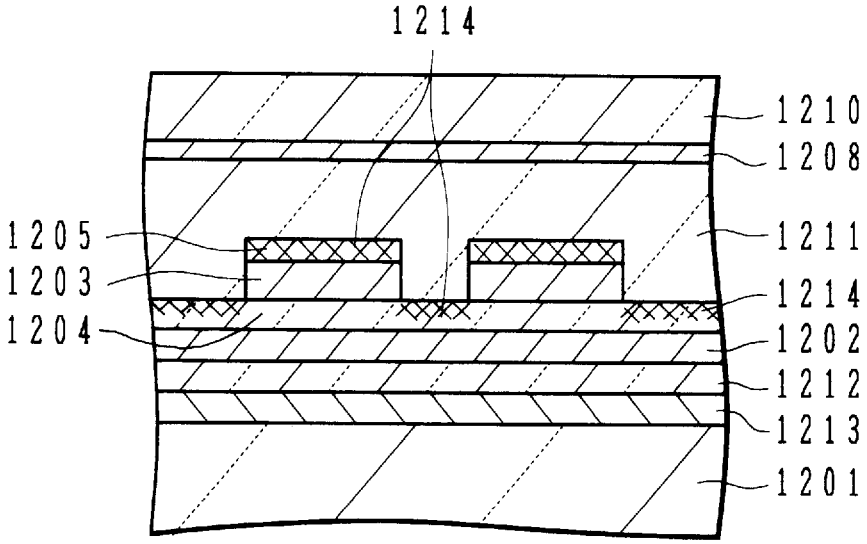
FIG.14A PRIOR ART
FIGS. 14A to 14B illustrate electrical contact between an emitter and a gate caused by permeated low melting point glass.
Figure 14B:
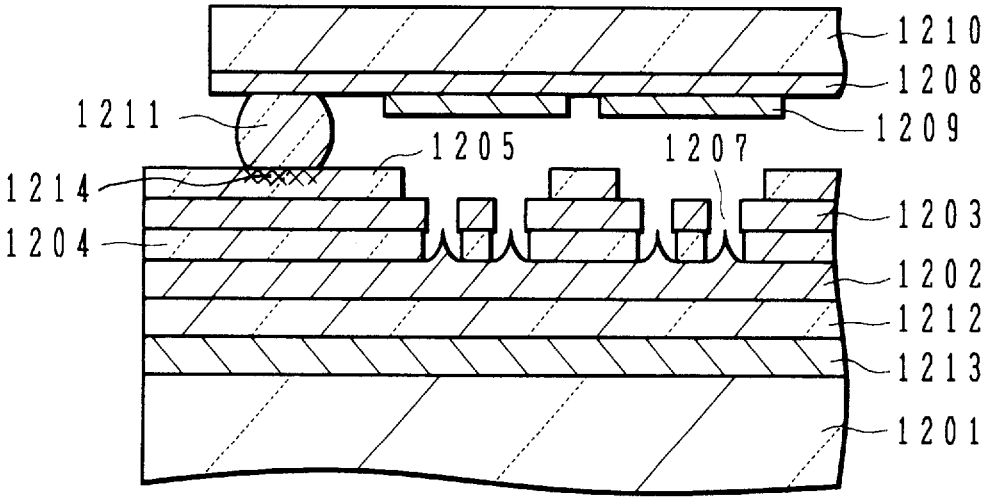
FIG.14B PRIOR ART
Figure 15:
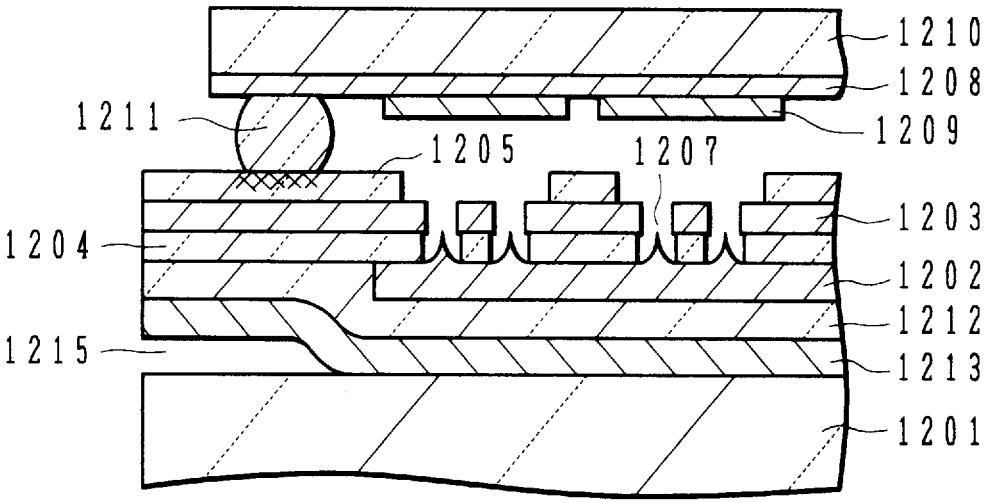
FIG.15 PRIOR ART
FIG. 15 is a cross sectional view corresponding to FIG. 14B wherein the emitter electrode material film under the gate line is removed.

Next, as shown in FIG. 12D, a gate electrode material film 3 made of Mo or the like is deposited, resist is coated on the whole surface to planarize it, and etched back until the gate electrode material film 3 protruding over the field emission emitter 8 is exposed, and dry etching is performed by using the remaining resist as a mask. In this manner, as shown in FIG. 12E, an opening 4 is formed in the gate electrode material film 3 at the area corresponding to the field emission emitter 8 and the first insulating film 5 is further etched to expose the field emission emitter 8.

Although not shown, the gate electrode material film is patterned to form gate lines and the second patterning of the emitter electrode material film 7 is performed to form emitter lines, in the manner similar to the above embodiment.

The similar advantageous effects can be obtained also by second embodiment.

The present invention has been described in connection with the preferred embodiments. The invention is not limited only to the above embodiments. It is apparent to those skilled in the art that various modifications, improvements, combinations and the like can be made without departing from the scope of the appended claims.

What is claimed is:

1. A method of manufacturing a field emission array, comprising the steps of:

a) providing a substrate having a gate layer and an insulating layer;

b) forming a hole through the gate layer;

c) forming a sacrificial layer over the gate layer, the sacrificial layer having a cusp thereon;

d) forming an electron emission layer on the sacrificial layer to provide a tip which is conformal to the cusp;

e) defining a space on the electron emission layer, which space is to be evacuated;

f) forming a plurality of slits in the electron emission layer within the space;

g) patterning the gate layer to provide a gate element in a vicinity of the tip and a contact electrode; and h) patterning the electron emission layer to provide an electron emitter layer and a dummy layer under the contact electrode, the dummy layer being electrically isolated from the electron emitter layer by the slit.

2. A method according to claim 1, wherein the electron emission layer is made of lamination of Ti and Cr, or Ti and Si.

3. A method according to claim 1, wherein the gate layer is made of Mo.

4. A method according to claim 1, wherein said step g) comprises the steps of:

patterning said insulating layer by selectively etching said insulating layer from a lower surface; and patterning said gate layer by selectively etching said gate layer from a lower surface, using said patterned insulating layer as a mask.

5. A method according to claim 4, wherein said step h) comprises the steps of:

patterning said sacrificial layer by selectively etching said sacrificial layer from a lower surface; and patterning said electron emission layer by selectively etching said electron emission layer from a lower surface using said patterned sacrificial layer as a mask.

6. A method according to claim 5, wherein said step f) comprises the step of partially etching said electron emission layer to form said slits and to define an inner and outer region of the electron emission layer, the inner region constituting electron emitters and the outer region constituting a dummy layer.

7. A method according to claim 6, further comprising the step of i) stacking said substrate on a seal plate and hermetically sealing the space therebetween, after said step h).

8. A method according to claim 7, wherein said step i) comprises the step of disposing sealing agent between a lower surface of the insulating layer and said sealing plate at a position where said dummy layer is projected.

9. A method according to claim 8, wherein said sealing agent is low melting point glass.

10. A method according to claim 9, wherein said substrate comprises a support layer, an insulating layer and a gate layer stacked on the support layer, and the method further comprises the step of removing said support layer by etching from a lower surface, between said steps f) and g).

* * * * *